United States Patent [19]

Stump

[11] Patent Number: 4,512,110

[45] Date of Patent: Apr. 23, 1985

[54] ENDLESS ABRASIVE BELTS

[75] Inventor: Lee E. Stump, Brooklyn Park, Minn.

[73] Assignee: Timesavers, Inc., Minneapolis, Minn.

[21] Appl. No.: 569,971

[22] Filed: Jan. 11, 1984

Related U.S. Application Data

[63] Continuation of Ser. No. 329,245, Dec. 10, 1981, abandoned.

[51] Int. Cl.[3] ..... B24B 21/08

[52] U.S. Cl. ..... 51/141; 51/145 T; 51/148; 51/165.79

[58] Field of Search ..... 51/135 R, 141, 145 T, 51/148, 165.79, 165.89, 328, 338, 165.75

[56] References Cited

U.S. PATENT DOCUMENTS

| | | | |
|---|---|---|---|
| 2,691,250 | 10/1954 | McMullen et al. | 51/26 |
| 2,971,263 | 2/1961 | Rockafellow | 51/165.75 X |
| 3,408,775 | 11/1968 | Rutt | 51/146 |
| 3,541,736 | 11/1970 | Takekawa | 51/141 |
| 3,570,190 | 3/1971 | Rutt et al. | 51/141 |
| 3,694,966 | 10/1972 | Heesemann | 51/138 |
| 3,859,757 | 1/1975 | Heesemann | 51/138 |
| 3,888,050 | 6/1975 | Elm | 51/135 R |
| 3,952,456 | 4/1976 | Leathley et al. | 51/56 R |
| 4,038,784 | 8/1977 | Grivna | 51/139 |
| 4,144,679 | 3/1979 | Herringhaus | 51/338 |

FOREIGN PATENT DOCUMENTS

| | | | |
|---|---|---|---|
| 2845366 | 5/1979 | Fed. Rep. of Germany | 51/141 |

*Primary Examiner*—Robert P. Olszewski

*Attorney, Agent, or Firm*—Orrin M. Haugen; Thomas J. Nikolai; Douglas L. Tschida

[57] ABSTRACT

Apparatus for controlling the working force and relative disposition of the work-contacting surface of a driven endless abrasive belt while in contact with the surface of a workpiece held in a working station. The controlling apparatus includes a rigid belt back-up pad which is normally biased in a direction toward the working station, and linear cams are provided which include inclined relatively movable ramps for movably positioning the belt back-up pad into predetermined spaced relationship to the working station. Also, because of the relatively high forces involved, guides are provided for controlling the movement of the belt back-up pad along axes which are normal to the axis of the working station.

7 Claims, 6 Drawing Figures

ENDLESS ABRASIVE BELTS

This is a continuation of application Ser. No. 329,245, filed Dec. 10, 1981 now abandoned.

TECHNICAL FIELD

The present invention relates generally to production machining equipment or apparatus utilizing endless abrasive belts, and wherein the apparatus is provided with a means to accurately position the belt guiding platen or contact drum relative to the surface of the work so as to positively and precisely control the position of the belt and repeatedly produce workpieces with a high degree of tolerance and flatness control. These objectives are accomplished in the apparatus without a reduction in production speed.

BACKGROUND OF THE INVENTION

Production machining equipment using endless abrasive belts are presently being used for the preparation and finishing of metallic parts, including cast aluminum parts and cast iron parts, as well as a host of others, with the abrasive belts being used for both grinding and finishing operations. The utilization of such equipment with abrasive belts provides a finished part which is both dimensionally accurate and has a desirable finished surface. The apparatus of the present invention finds application with endless abrasive belts driven at high rates of speed, and provide advantages in use, particularly from the standpoint of high production rates, as well as the preparation of parts having relatively accurate finished dimensions, a high degree of flatness, and a surface with desirable characteristics. In addition to use with metals, the apparatus of the present invention is also adapted for use with other structural materials such as wood.

In the past, and in connection with production machining, various techniques have been employed to control the disposition of a workpiece while held within a working station. In the apparatus of the present invention, however, means are provided for precisely adjusting the position of the working surface of an endless abrasive belt relative to the surface of the workpiece being treated while the workpiece is being held within the working station. This precise adjustment feature is achieved by virtue of a system which controllably advances and retracts the platen or contact drum carrying the working surface of the belt while maintaining the working force substantially constant. The motion of the platen or contact drum is undertaken in response to programmed or controlled input signals. Thus, in addition to controlling the disposition of the work-contacting surface of the belt, the system maintains a substantially constant working force or bias to normally drive the belt back-up means against or toward the working station.

As an added feature, and in order to enhance and maintain accuracy in the grinding and/or finishing operations, means are provided to constantly monitor the position of the belt back-up means in order to compensate and accommodate for the inevitable occurrence of belt wear.

BRIEF SUMMARY OF THE INVENTION

In accordance with the present invention, a production machining apparatus is provided which is equipped with means to positively and precisely advance and retract the belt-guiding mechanism of an endless belt grinding machine in order to control the relative disposition of the work-contacting surface of the belt. While in contact with the work, a substantially constant working force is maintained on the belt, with the force being applied during the time that the surface of the belt remains in contact with the surface of a workpiece held within a working station. The working force is applied to the belt through a platen or a contact drum, with the platen or contact drum functioning as a rigid back-up pad or means for the belt. The machining apparatus includes, of course, the conventional drive means for establishing a predetermined orbital path for the endless abrasive belt, and wherein the working path includes a zone for arranging abrading contact between the abrasive belt and the opposed surface of a workpiece. Also, work retaining means are provided for holding or otherwise positioning a workpiece within the working station so as to maintain appropriate working contact between the abrasive belt and the surface of the workpiece.

More specifically, however, the present invention provides apparatus for precisely and adjustably positioning an endless abrasive belt relative to the surface of a workpiece to be treated, wherein the controllable adjustment means advance and positively position the belt into a predetermined working disposition relative to the workpiece for the grinding operation. Between operations, the belt is retracted to an idling position. In addition to the positioning function, resilient bias or force-applying means are provided in the system which normally urge the rigid back-up means toward the work surface. This resilient bias which is applied against the work is substantially constant, with the arrangement being such that normal variations in the thickness of the workpiece will not provide any significant variation in the magnitude of the applied force.

Precise control and positive positioning of the working surface of the belt is achieved through controlled movement of the belt back-up means. To achieve this movement, a plurality of matched linear cams are provided which are arranged for simultaneous reciprocal motion, so as to advance the belt back-up member to a previously predetermined position relative to the surface of the workpiece when the cams are moved in one direction, and to retract the back-up member when the cams are moved in the reverse direction. In order to achieve precise motion of the linear cams, a stroking means is provided, preferably in the form of a rotary cam to generate simultaneous reciprocatory to-and-fro movement of each of the cams. The rotary cam is preferably fastened on a rotatable shaft which rotates in time or otherwise in sychrony with the machine cycles, thereby appropriately timing the movement of the working surface of the belt to accommodate individual machine cycles. Also appropriate or desirable rates of motion for the belt back-up pad may be provided by means of appropriately profiling the rotary cam. In certain instances a separate drive with limit switches may be employed to drive the rotary cam. The to-and-fro reciprocatory movement of the linear cams is translated into an accurate, positive, reliable and durable motion generating system for the belt back-up means, thus achieving the objective of precise positioning of the abrasive belt relative to the surface of the work.

In this arrangement, the term "belt back-up means" is intended to apply to either platen heads or contact drums. Typically, a contact drum or cylinder is utilized for heavy stock removal of parts or components fabricated from relatively hard materials, such as for parts fabricated from cast iron. Alternatively, in the grinding of relatively soft materials or metals such as aluminum, a platen back-up means may be used, which presents a relatively larger area of the belt to the work. For finishing operations conducted upon parts fabricated from materials with any of the normal degree of hardness, including cast iron, platen heads will normally be employed. Platen heads generally provide for a high degree of flatness in the finished work, and also achieve good control of the tolerances of the finished parts.

In achieving the high degree of accuracy with the apparatus of the present invention, means are provided to assure that the belt back-up means or pad moves along an axis which is normal to the plane of the working surface. This accuracy is further enhanced by providing a frame means which includes guiding means which control the movement of the belt back-up member along a singular axis of motion so as to eliminate motion in or along any other axial direction. In other words, the motion of the belt back-up pad, in either cylindrical drum or platen form, is achieved along a highly linear and reciprocatory path. This extraordinary motion control feature enhances the degree of flatness and close tolerance control in the finished work product.

As has been indicated, means are provided to establish a substantially constant bias or working force between the belt and the work for repeated cycles, each cycle being undertaken with a new workpiece. This force is achieved by the utilization of one or more resilient air-retaining enclosures, commonly referred to as "airbags", which provide a substantially uniform working pressure to be exerted or applied between the belt and the work. These airbags can act, in certain unusual situations, to accommodate acceptance and treatment of incoming parts or components with somewhat differing dimensions. In other words, the utilization of one or more airbags will permit the machine to function through the application and delivery of a substantially uniform working force or pressure without significant changes in the working force being introduced through the introduction of a modestly oversized or undersized part into the working station.

In certain instances, a greater working force is necessary for a grinding head utilizing a contact roll as contrasted with a platen head, since a contact roll assembly is normally utilized for grinding relatively hard material such as cast iron or the like. Such an application may require a greater number of airbags to achieve the working force desired.

The linear cams, in the form of inclined relatively movable ramps, are provided with linear roller bearings to increase the accuracy and to reduce the friction generated due to contact between the mating ramp surfaces. The surfaces of the linear cams or ramps are preferably hardened for wear resistance. The design of the present structure, utilizing linear cams, provides the apparatus with a feature permitting controllable advancment of the belt back-up pad at a substantially uniform rate and along an axis which is substantially normal to the surface of the work.

In a typical metal-treating operation, the control apparatus of the present invention will be disposed in a working disposition which is immediately above the working station, and opposed to the surface of the work to be treated. This physical arrangement of components, while not necessary to the utilization of the invention, provides a working arrangement wherein the motion of the linear cams allows the belt back-up means to be lowered (advanced) at a controllable rate and along a predetermined axis, with motion of the linear cams in the opposite direction permitting retraction of the belt away from the work.

As was indicated previously, means are provided to adjustably reposition the belt back-up means to accommodate the inevitable wear occurring on the belt. Specifically, this repositioning means provides a new datum point for the back-up means so that the ultimate extent of the stroke or throw of the platen remains constant, thereby contributing to the generation of uniform workpieces. However, when the abrasive belt is replaced, the adjustable repositioning means is designed to permit reestablishment of the original datum point so that the ongoing treatment of the individual workpieces remains uniform or constant.

Therefore, it is a primary object of the present invention to provide an improved means for controlling the working force and relative disposition of the work-contacting surface of a driven endless abrasive belt which includes means to adjustably position the belt relative to the surface of a workpiece, and wherein the adjustable positioning of the belt includes positive camming means which operate simultaneously and in cooperation with a mechanical resilient biasing or force-applying means to normally urge the belt in a direction toward the work.

It is a further object of the present invention to provide an improved apparatus for controlling the working force and relative disposition of the working surface of a driven endless abrasive belt, and wherein a plurality of linear cam means in the form of relatively movable inclined ramps are provided for movably positioning a belt back-up pad into predetermined spaced relationship relative to the surface of a workpiece disposed in a working station.

It is yet a further object of the present invention to provide an improved apparatus for controlling the working force and relative disposition of the working surface of a driven endless abrasive belt for treating the surface of a metal workpiece held in a working station, and wherein the apparatus for controlling the motion of the endless abrasive belt toward and away from the work includes relatively movable linear cams in the form of inclined ramps, and wherein the motion for the relatively movable ramps is achieved through a rotary cam timed to the overall machine cycle.

It is still a further object of the present invention to provide an improved apparatus for controlling the applied working force and relative disposition of the surface of a driven endless abrasive belt relative to a workpiece, and wherein linear cam means are provided for movably positioning a back-up pad for the belt in predetermined spaced relationship to the work, and wherein means are provided to resist motion of the belt back-up pad means except along an axis normal to the plane of the work.

Other and further objects of the present invention will become apparent to those skilled in the art upon a study of the following specification, appended claims, and accompanying drawings.

DESCRIPTION OF THE PREFERRED EMBODIMENT

Figure 1:
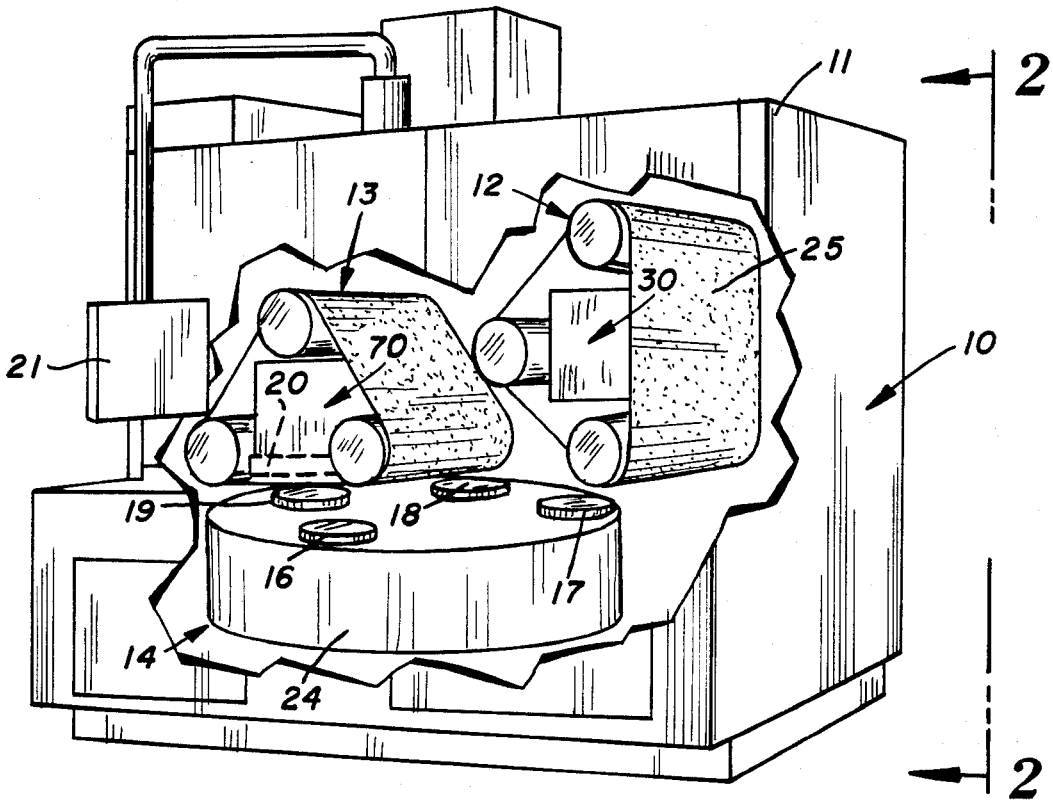
FIG. 1 is a perspective view of a typical machine employing endless abrasive belts for treating metal articles, and illustrating the machine with a pair of dissimilar working stations therein, with a portion of the housing being cut away to expose each of the operating stations, and with one of the stations showing in the device of FIG. 1 utilizing a contact drum, and the other utilizing a platen head.
Figure 2:
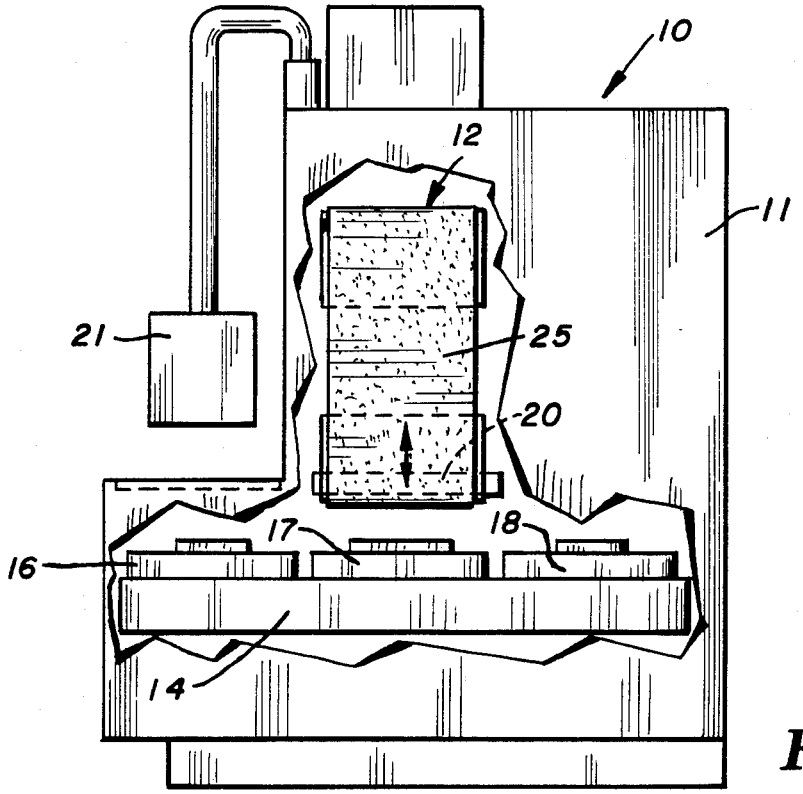
FIG. 2 is a vertical sectional view taken along the line and in the direction of the arrows 2—2 of FIG. 1.

In accordance with the preferred embodiment of the present invention, and with particular attention being directed to FIGS. 1 and 2 of the drawings, the metal surfacing machine shown generally at 10 includes an enclosure or housing 11 with a pair of operating stations including a grinding station shown generally at 12 utilizing a contact drum, and a finishing station shown generally at 13 utilizing a platen head. A rotary indexing table is shown generally at 14 and provides for intermittent motion to carry the workpieces from a load-unload station through the operational stations 12 and 13 and ultimately returning to the load-unload station. More specifically, table 14 is a rotary indexing table which carries the work from the load-unload station through a grinding station and then through a finishing station, with each station being disposed beneath individual endless abrasive belts. As can be appreciated, the rotary indexing table 14 normally operates on intermittent motion, providing alternate periods of rotary motion and dwell. In certain instances, the apparatus may provide for rotating of the work in the working stations while in operational contact with the individual belts. In the apparatus shown in FIG. 1, there is one station disposed intermediate the working stations. This is a station which merely retains the work at rest and may provide for cooling of the work between operations. The details of such a rotary indexing table are shown in U.S. Pat. No. 3,816,998, the details of which are incorporated by reference herein.

Accordingly, the rotary indexing table 14 contains the four previously mentioned stations, including the load-unload station at 16, the working station 17 employing a contact drum at which grinding operations are undertaken, the rest station as at 18, and the finishing station as at 19 employing a platen as shown in phantom at 20. As is typical in apparatus of this type, a control console is provided, with one being shown externally of the enclosure as at 21.

THE CONTACT DRUM EMBODIMENT

Figure 3:
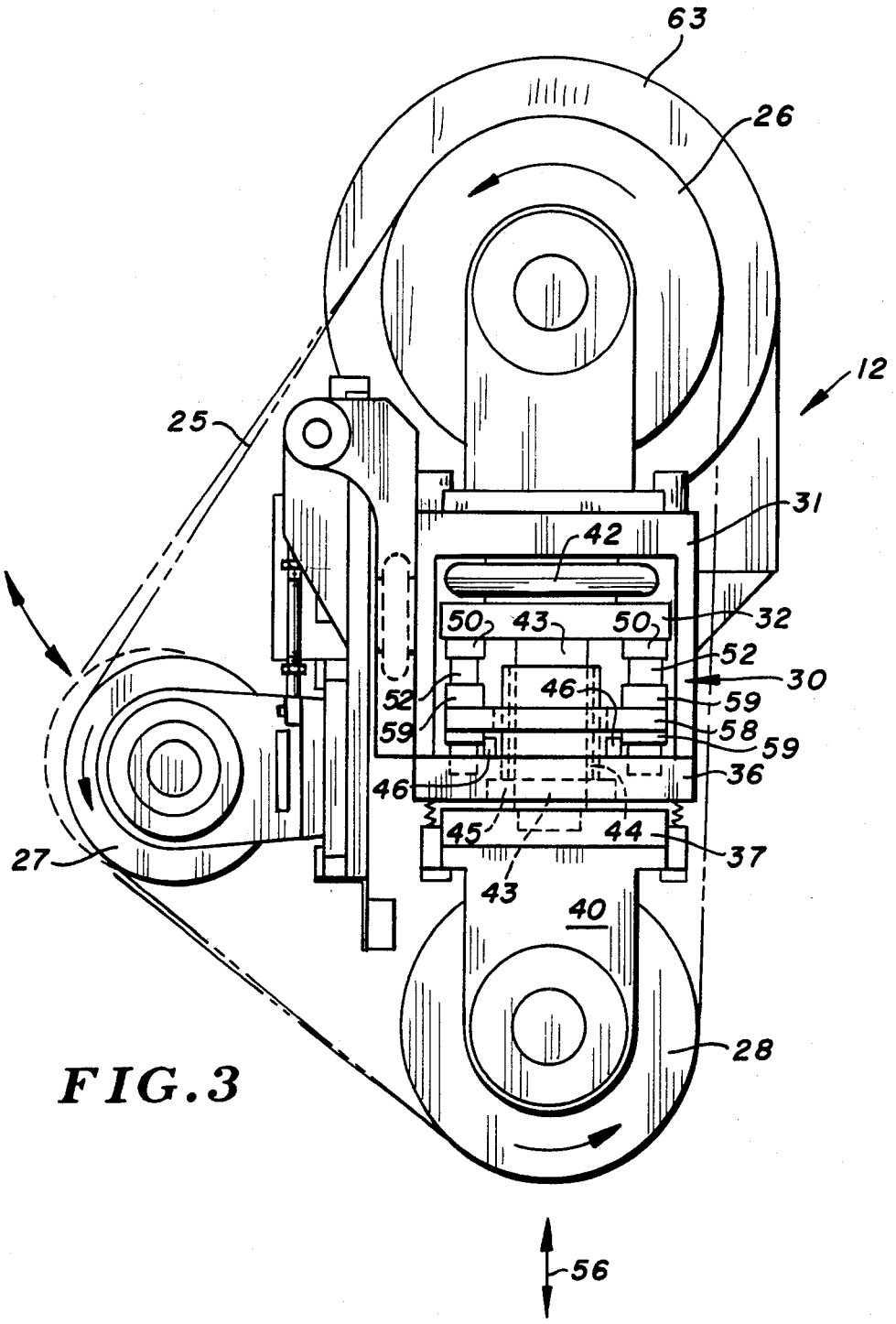
FIG. 3 is a detailed end elevational view, on a slightly enlarged scale, of a typical operational station utilizing a contact drum.

With particular attention being directed to FIG. 3 of the drawings, it will be observed that the grinding head assembly generally designated 12 includes three drums, rollers or cylinders about which the abrasive belt, such as belt 25, is trained and driven. A drive roll is illustrated at 26, with a tensioning-idler roll being shown at 27, along with a contact drum or roll 28 being provided. Belt control apparatus pursuant to the present invention generally designated 30 is combined within the assembly so as to arrange the working force and relative disposition of the contact drum along with the work-contacting surface of the belt 25. Grinding heads of the type shown in FIG. 3, with the exception of the belt control 30, are generally known and available, with one such device being illustrated in U.S. Pat. No. 3,816,998.

With continuing attention being directed to FIG. 3, along with specific attention being directed to FIG. 4, the belt control apparatus 30 will be described in greater detail. Control apparatus 30 is disposed within a portion of the frame of grinding head 12, such as within the inverted channel 31. In the control apparatus 30, an airbag contact support plate 32 is provided which functions as a force-receiving and delivering plate in combination with the individual airbags, as will be discussed in detail hereinbelow. Plate 36 is provided adjacent the lower end of control apparatus 30, and serves as a cam support plate or pad. Beneath the cam support plate 36 is positioned a contact drum support plate 37, which, in turn, carries a pair of axially spaced contact roll support brackets 40—40, one of which is ilustrated in FIG. 3. Suitable journal means or bearings are provided in brackets 40—40 to accommodate the rotary motion of contact roll 28.

In order to provide for a normal machine bias or working force, a plurality of airbags such as illustrated at 42—42 are employed. These airbags are, of course, commercially available, and provide a resilient means for continuously applying a mechanical bias or force to the belt back-up means, in this case contact roll 28. By controlling the air pressure maintained within each of the airbags 42—42, the forces normally appied to the contact drum for biasing the drum against the work during grinding operations will be determined.

As indicated hereinabove, means are provided within control apparatus 30 to move the belt back-up pad means (which in this embodiment is the contact drum 28) along an axis which is normal to the plane of the working station. For added control of the motion, guideposts such as at 43—43 are provided. These guideposts prevent any side motion of support plate 37 from occurring during operation of the system. The guideposts will normally be in the form of solid shafts, each of which is received within sleeve bearings 44—44 held within plate 36 to accommodate the reciprocatory motion of the support plate 37. Each of the sleeve bearings 44—44 is preferably retained within a bearing housing as at 45, when the application is indicated. Also, in order to further assist in precise control of the motion of plate 37, laterally disposed way-guides 46—46 are provided which control and otherwise guide the motion of cam feed support plate portion 58 of slidable adjustment plate assembly 54, as will be more fully described hereinafter.

part of the control apparatus 30, adjustable positioning means are provided, such as the complementary linear cam means or ramps shown at 50—50 and 51—51. Interposed between each of the mating surfaces of the individual linear cams 50—50 and 51—51 is a linear bearing such as at 52. Linear bearings for such applications are commercially available. Linear cams 51—51 are adjustably positionable by virtue of the slidable adjustment plate assembly illustrated generally at 54, thereby effectively and adjustably controlling the disposition of the ramps 51—51, and ultimately the elevation of contact drum support plate 37 and the working surface of the abrasive belt. Linear motion of the linear cams or ramps 51—51 in the direction of the double-headed arrow 55 provides for vertical reciprocatory motion of support plate 37 (and its contact drum 28) in the direction of the double-headed arrow 56, with motion of plate 54 toward the left in FIG. 4 lowering the elevation of plate 37.

Figure 4:
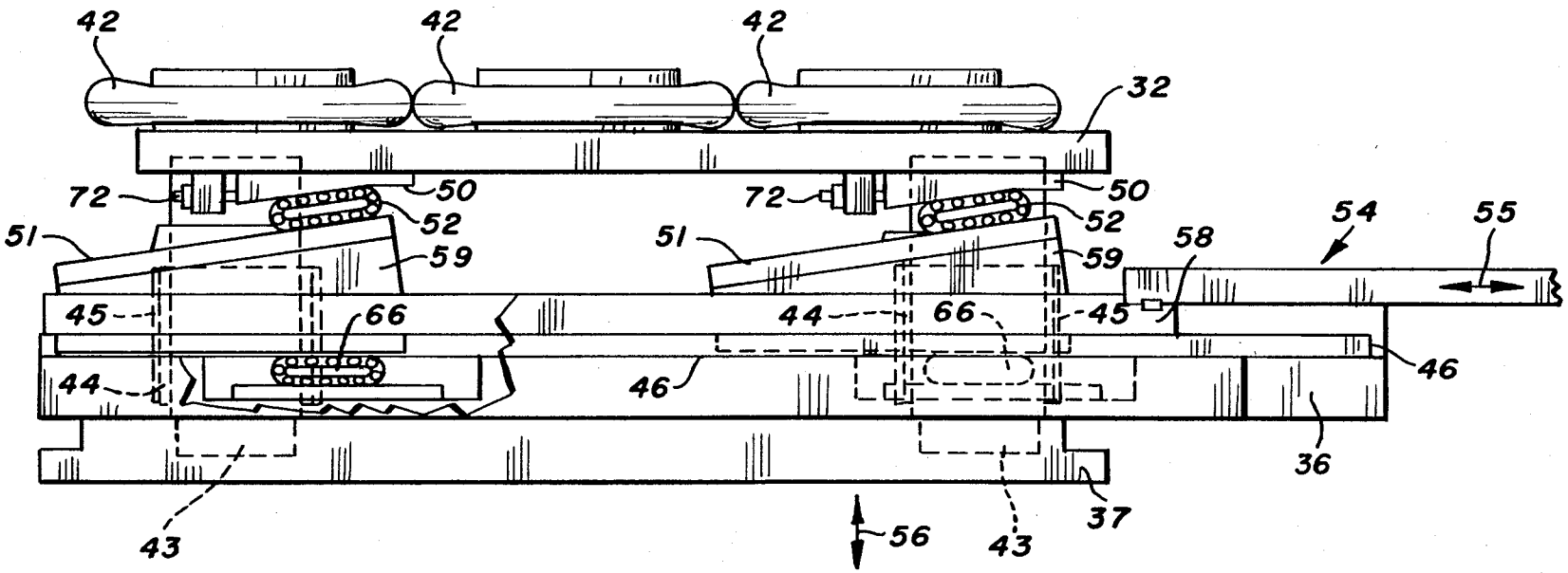
FIG. 4 is a vertical sectional view taken along the line and in the direction of arrows 4—4 of FIG. 3, and showing the control system of the present invention as it is utilized to generate the working force and to control the relative disposition of the surface of the abrasive belt as employed in the structure shown in FIG. 3.

Cam support plate 36 carries and supports the cams 51—51 through their associated base wedges 59—59 as best illustrated in FIG. 4. Plate 58 is moved linearly through the action of a rotary cam, such as is shown in combination with the platen embodiment illustrated in FIGS. 5 and 6. The rotary cam moves plate 58 in the direction of double-headed arrow 55. Briefly, and with reference to those features which are common between the contact drum embodiment and platen embodiment, rotary cam 61 is fastened on motor shaft or cam driving shaft 62, which runs in time with the machine cycle. The cam position and its motion is monitored by a pair of limit switches, with one switch being utilized to detect the fully retracted position of the grinding head, and with the other being utilized to detect the termination of a complete rotation of the cam shaft, thereby interrupting any further rotation of cam shaft 62 until the commencement of the next machine cycle. Additional details of this feature are described hereinbelow. Cam follower wheel 64 may be employed to assist in smoothly translating rotational energy of cam 61 to cam feed support plate 58.

It will be observed that cam 61 may be profiled to accommodate individual operations of the production machining apparatus. For example, the rate at which the belt surface advances toward and retracts from the surface of the work may be appropriately and easily accommodated by the specific cam profile selected.

As has been previously discussed, linear bearings are provided to reduce frictional contact between the mating surfaces of the inclined ramps 50—50 and 51—51. In order to further reduce friction in the system, and accommodate reciprocatory motion of the cam feed support plate 58, additional linear bearings are provided as at 66—66. Preferably, linear bearings 66—66 are disposed along a common center with linear bearings 52—52, thereby accomplishing the desired rolling and non-binding motion for the entire system through proper loading of the bearings. Also, simultaneous motion of the linear bearings is accomplished, inasmuch as the individual ramps or linear cams which form a part of the system are all moved simultaneously.

THE PLATEN EMBODIMENT

Figure 5:
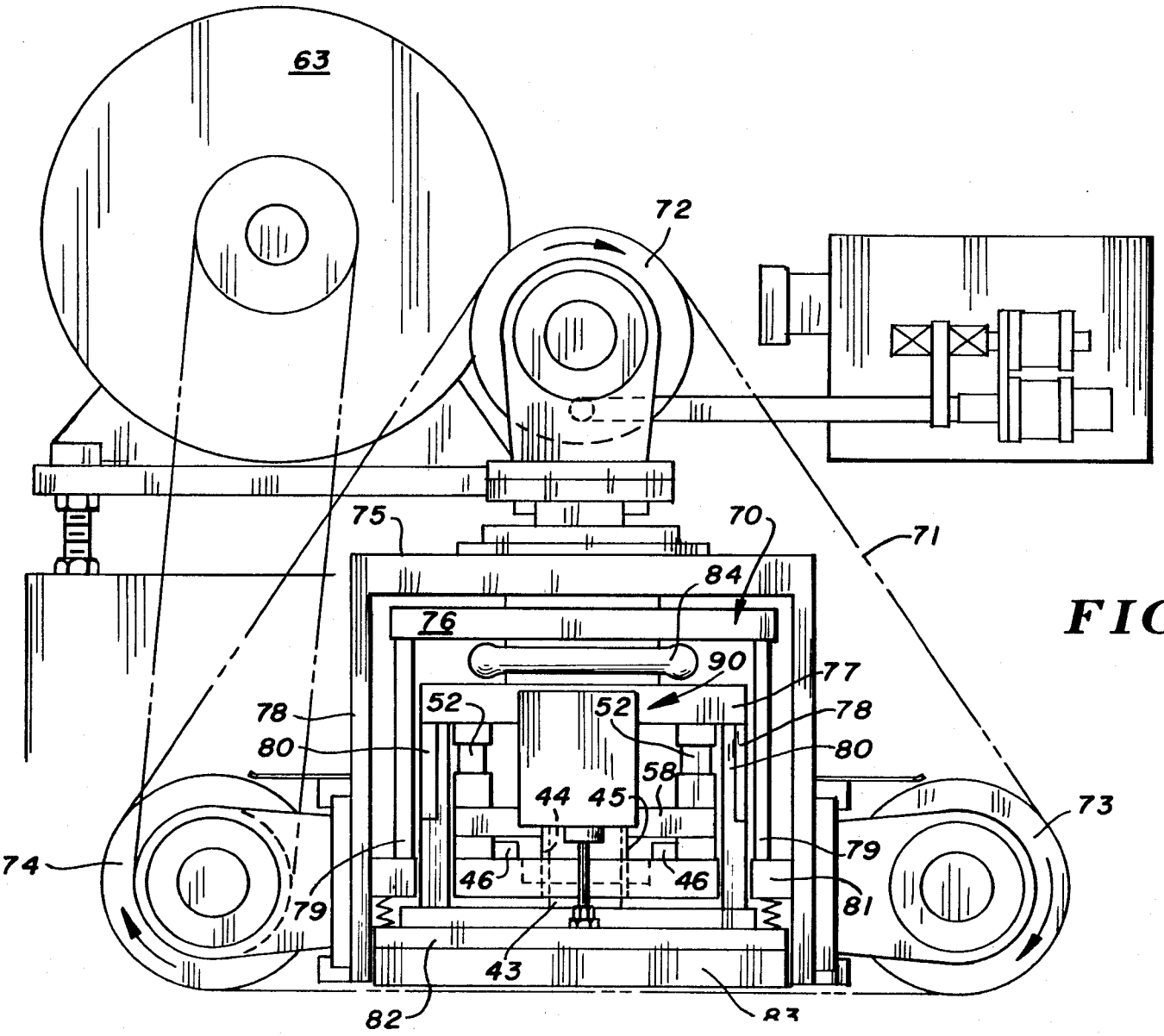
FIG. 5 is a detailed end elevational view of a second typical operational station utilizing a platen head, and further illustrating a belt-tracking system in combination with the platen head.
Figure 6:
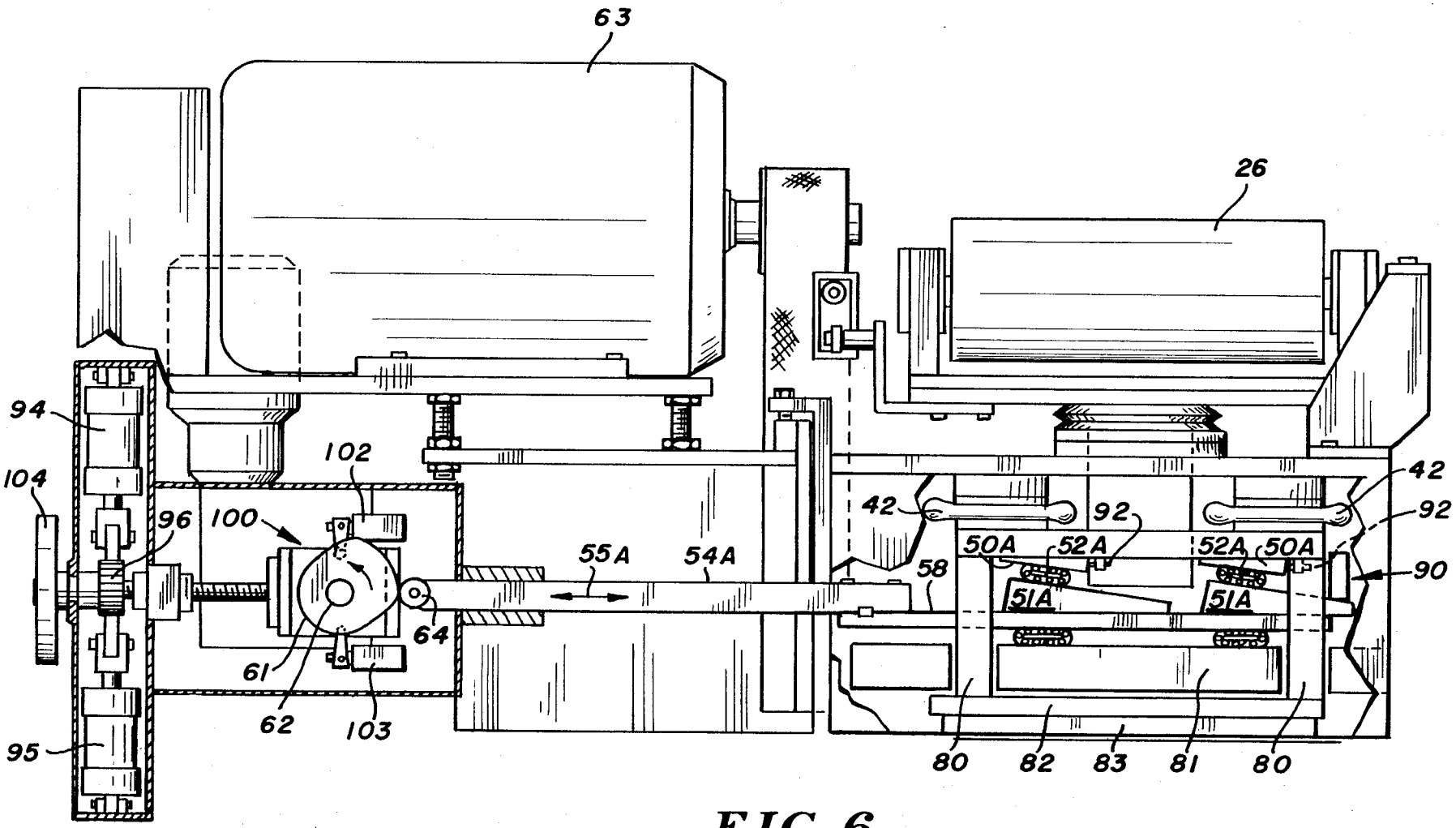
FIG. 6 is a front elevational view of the apparatus illustrated in FIG. 5, illustrating details of the means utilized to provide motion between the linear cams, and further illustrating details of the datum setting system utilized in order to reposition or reset datum points to accommodate belt wear.

Attention is now directed to FIGS. 5 and 6, which illustrate an alternate embodiment of the invention wherein the apparatus is utilized in a platen head arrangement. As can be appreciated, there are, of course, a number of components which are common between this embodiment and the contact drum embodiment, and in those instances, the common elements will frequently bear the same reference numerals as have been previously utilized in the drum embodiment or may carry an alphabetical suffix.

In the platen head embodiment, the assembly generally designated 70 includes three drums, rollers or cylinders about which the abrasive belt 71 is trained and driven. A drive roll is shown at 74, with two idler rolls being shown at 72 and 73. Rollers 72, 73 and 74 define the basic path for belt 71, with the movable platen being used to control the plane of the working surface of the belt, as will be more fully described hereinafter. Control apparatus 70 functions in a manner similar to that which has been described in connection with control apparatus 30, with the essential differences being due to the fact that control apparatus 30 functions with a contact drum, while control apparatus 70 functions with a platen. Control apparatus 70 is enclosed within the inverted channel 75 and includes a frame means with an upper plate 76 together with an airbag force-receiving and delivering plate 77. Side plates are provided as at 78—78, and lateral support posts are provided at 79—79. Side plates 78—78 include, as components, support posts or columns 80—80, which are, in turn, slidably received within cam support plate 81. Beneath cam support plate 81, and secured to support post 80—80, is platen support plate 82 which, in turn, carries and supports platen 83. Suitable journal or bushing means are provided in cam support plate 81 to accommodate motion of support posts 80—80 therethrough, such as shown at 44-45 similar to the embodiment of FIGS. 3 and 4.

In order to provide for the normal machine bias or force necessary during operations, a plurality of airbags such as are shown at 84—84 are employed. It will be appreciated that airbags 84—84 fulfill substantially the same function in the platen head apparatus as do airbags 42—42 in the contact drum apparatus.

With continuing attention being direction to the platen head arrangement shown in FIGS. 5 and 6, means are provided to control the movement of the platen 83 along an axis which is essentially normal to the plane of the working station. In this connection, posts 80—80 are rigid and durable, with these posts preventing any anomalous motion, such as side motion, from occurring during the normal operation of the system. Posts 80—80 will normally be received within bearings, bushings or guides disposed in plate 81, so as to accommodate the reciprocatory motion of platen 83 while reducing friction as well.

As with the contact drum embodiment, adjustable positioning means are provided for the platen in the form of a plurality of complementary linear cam means or ramps shown at 50A—50A and 51A—51A. Interposed between each of the mating surfaces of the individual linear cams 50A—50A and 51A—51A is a linear bearing such as at 52A. Linear cams 51A—51A are adjustably positionable by virtue of the motion of slidable cam feed support plate 58. Cam feed support plate 58 is, in turn, secured to the slidable adjustment plate or bracket 54A. Linear motion of linear cams 50A—50A and 51A—51A in the direction of the double-headed arrow 55A provides for vertical reciprocatory motion of platen 83, much in the same fashion as vertical reciprocatory motion is achieved with the contact drum embodiment of FIGS. 3 and 4. Hence, for purposes of the platen head system, reference is made to the operational characteristics of cam 61 and its associated components for a description of this section of the operational features of this embodiment.

BELT DATUM POSITIONING SYSTEM FOR CONTACT DRUM AND PLATEN HEAD EMBODIMENTS

Attention is now drawn to the transducer means which determines the position of the abrasive belt relative to the surface of the working station. This feature of the system, while common to and useful in both the contact drum and platen head embodiments, is illustrated in FIG. 6 of the drawings. Specifically, the belt datum control system illustrated generally at 90 incorporates a linear variable displacement transformer which functions as a precision transducer to controllably measure and indicate the immediate position of the grinding head. Also, the precision transducer may be utilized to show a correction or re-establishment of the datum point to accommodate wear of the abrasive belt and maintain accuracy through this re-establishment of the datum point. Specifically, the variable displacement transformer will generate a signal which may be displayed on a dial or a digital display instrument to indicate the immediate displacement, and thus the position of the contact drum in a drum system, or the platen in a platen system. For achieving initial adjustment of the linear ramps, set screws such as at 92—92 may be provided. Such adjustment aids in establishing and maintaining alignment of the individual linear bearings and compliments the datum system. Furthermore, and as illustrated in FIG. 6 of the drawings, means such as in the form of an air cylinder, as at 94 and 95, may be utilized to make incremental adjustments to accommodate belt wear and re-position the datum point for consistency. Cylinder 94 may be utilized to incrementally rotate adjustment sleeve 96, with this adjustment laterally re-positioning the cam driving shaft and the rotary cam. Specifically, as illustrated generally at 100, a slidable shaft housing is employed to establish a periodically fixed advance or retract position for rotary cam 61, thereby allowing the grinding head to lower a predetermined fixed distance sufficient to re-establish or re-align the grinding surface with the same plane as other grinding heads (when there is more than one grinding head in a machine), and also to accommodate and compensate for abrasive belt wear. For implementation, adjustment sleeve 96 may be employed in combination with a handwheel, such as handwheel 104. Apparatus such as the air cylinders 94 and 95 for incrementally advancing or retracting adjustment sleeve 96 are commercially available.

In the event the motor driving shaft 62 is not timed directly with the main machine motor, limit switches such as illustrated at 102 and 103 may be employed and actuated in time with rotary indexing table 14 as discussed hereinabove. It can be appreciated, however, that the requirements of the individual apparatus will determine whether or not the means utilized to energize shaft 62 will be linked directly to the rotary indexing table 14 or to other independent means. Those skilled in the art may, of course, select the means most appropriate for the individual operations.

Accordingly, the apparatus of the present invention provides a means for precisely and controllably advancing and retracting the working surface of an endless abrasive belt, as that surface is either advanced toward or retracted from the surface of a workpiece. The arrangement is such that the axis of motion of the working surface of the belt is precisely controlled, and thereby provides minimal, if any, run-out or unevenness in the application of the surface of the abrasive belt against the work.

As a further feature of the invention, the arrangement provides for means to maintain a substantially constant working force or bias between the abrasive belt and the surface of the work being treated.

I claim:

1. Apparatus for controlling the working force and relative disposition of the work-contacting surface of a driven endless abrasive belt while in contact with the surface of a workpiece held within a working station, said apparatus comprising, in combination:

(a) drive means for establishing a predetermined orbital working path for an endless abrasive belt and wherein said working path includes a zone for arranging abrading contact between said abrasive belt and a workpiece held within a working station;

(b) a first frame means disposed in spaced relationship to said drive means and including at least one working station;

(c) work retaining means for positioning a workpiece within said working station and for arranging abrading contact between said workpiece and said abrasive belt; and (d) means for adjustably positioning said endless abrasive belt in a planar parallel fashion relative to the surface of a workpiece within said working station, said adjustable positioning means comprising:

(1) second frame means for retaining said adjustable positioning means;

(2) abrasive belt back-up means having a first support plate mounted in planar parallel fashion relative to a second support plate, said first support plate movable along a first axis and said second support plate movable along a second axis and a third support plate coupled to said first support plate via at least one extendable guideposts and movable along said first axis;

(3) at least one inflatable airbag coupled to said first support plate for applying a predetermined normal bias along said first axis to said first support plate in and toward said workpiece;

(4) a rigid linear cam means coupled intermediate said first and second support plates and movable along said second axis and comprising at least one pair of complementary mating inclined relatively movable ramps for movably positioning said third support plate along said first axis in a predetermined spaced relationship relative to said working station so as to bring said work-contacting surface into a substantially parallel orientation relative to the workpiece in said working station;

(5) rotating cam means coupled to said linear cam means for generating reciprocatory to-and-fro movement between said mating inclined ramps along said second axis and thereby controlling the extent of movement and ultimate position of said abrasive belt back-up means along said first axis relative to said abrasive belt during each machine cycle; and (6) said rotating cam means comprises a rotating adjustment sleeve coupled to a cam drive shaft and which cam drive shaft is, in turn, coupled to a slidable shaft housing and said rotating cam means, and wherein a means for correctively repositioning said back-up means and abrasive belt relative to a workpiece to accommodate belt wear comprises first and second controlled air cylinders diametrically mounted in opposed relation to each other and tangent to said adjustment sleeve for incrementally rotating said sleeve and thereby laterally correcting said housing on said cam drive shaft and correspondingly retracting or advancing said rotating cam means coupled to said linear cam means.

2. The combination as defined in claim 1 being particularly characterized in that a transducer means including a variable displacement transformer is provided for determining the position of said abrasives belt back-up means relative to the plane of said working station.

3. The combination as defined in claim 1 being particularly characterized in that linear bearing means are positioned between the opposed mating surfaces of said inclined ramps for reducing friction during relative motion of said inclined ramps.

4. The combination as defined in claim 1 being particularly characterized in that said third support plate of said abrasive belt back up means includes a pair of brackets and from which a cylindrical contact drum is rotatively suspended.

5. The combination as defined in claim 1 being particulary characterized in that said third support plate of said abrasive belt back-up means includes a platen.

6. The combination as defined in claim 1 wherein said linear cam means includes set-screw means coupled to each of said mating pairs of inclined ramps for establishing an initial relative relation therebetween and thereby an initial separation between said abrasive belt and the surface of said workpiece being abraded.

7. The combination as defined in claim 3 including linear bearing means positioned between the opposed surfaces of said second support plate and said third support plate.

* * * * *